US006978490B2

(12) United States Patent
Wilson

(10) Patent No.: US 6,978,490 B2
(45) Date of Patent: Dec. 27, 2005

(54) AUTOMATICALLY OPERATED HANDLE-TYPE FLUSH VALVE

(75) Inventor: John R. Wilson, Naperville, IL (US)

(73) Assignee: Sloan Valve Company, Franklin Park, IL (US)

( * ) Notice: Subject to any disclaimer, the term of this patent is extended or adjusted under 35 U.S.C. 154(b) by 165 days.

(21) Appl. No.: 10/705,617

(22) Filed: Nov. 10, 2003

(65) Prior Publication Data

US 2004/0226083 A1 Nov. 18, 2004

Related U.S. Application Data

(63) Continuation-in-part of application No. 09/916,468, filed on Jul. 27, 2001, now Pat. No. 6,643,853.

(51) Int. Cl.[7] ..... E03D 5/00
(52) U.S. Cl. ..... 4/249; 4/302; 4/DIG. 3
(58) Field of Search ..... 4/249, DIG. 3, 4/302, 305, 313; 251/129.11, 291, 129.03, 129.04

(56) References Cited

U.S. PATENT DOCUMENTS

| | | | | |
|---|---|---|---|---|
| 1,292,444 A | * | 1/1919 | Doyle, Jr. | 4/249 |
| 2,388,990 A | * | 11/1945 | Nelson et al. | 4/DIG. 3 |
| 2,999,191 A | * | 9/1961 | Muradian et al. | 4/DIG. 3 |
| 3,019,453 A | * | 2/1962 | Radcliffe | 4/249 |
| 3,056,143 A | * | 10/1962 | Foster | 4/249 |
| 3,082,790 A | * | 3/1963 | Whitney | 137/624.14 |
| 3,778,023 A | | 12/1973 | Billeter | |
| 4,604,735 A | | 8/1986 | Parsons | |
| 4,839,039 A | | 6/1989 | Parsons et al. | |
| 4,847,924 A | * | 7/1989 | Samaniego | 4/249 |
| 4,921,211 A | | 5/1990 | Novak et al. | |
| 4,971,094 A | * | 11/1990 | Gonzalez | 251/129.04 |
| 5,125,621 A | | 6/1992 | Parsons et al. | |
| 5,169,118 A | | 12/1992 | Whiteside | |
| 5,195,720 A | | 3/1993 | Nortier et al. | |
| 5,224,685 A | | 7/1993 | Chiang et al. | |
| 5,244,179 A | | 9/1993 | Wilson | |
| 5,251,188 A | | 10/1993 | Parsons et al. | |
| 5,295,655 A | | 3/1994 | Wilson et al. | |
| 5,313,673 A | | 5/1994 | Saadi et al. | |
| 5,431,181 A | | 7/1995 | Saadi et al. | |
| 5,456,279 A | | 10/1995 | Parsons et al. | |

(Continued)

FOREIGN PATENT DOCUMENTS

| | | |
|---|---|---|
| TW | 84110990 | 1/1996 |
| WO | WO 91/17380 A1 | 11/1991 |
| WO | WO 01/29464 A1 | 4/2001 |

*Primary Examiner*—Khoa D. Huynh
(74) *Attorney, Agent, or Firm*—Cook, Alex, McFarron, Manzo, Cummings & Mehler, Ltd.

(57) ABSTRACT

A toilet room flush valve has a valve handle and an actuator mounted on the valve body to cause either sensor-initiated automatic movement or user-initiated manual movement of the valve handle. The actuator includes a handle assembly pivotally mounted in a housing. The handle assembly has an interface which is normally engaged with the valve handle. A motor driven push rod mounted on the handle assembly is engageable with the handle. A drive motor is mounted on the handle assembly and connected to the push rod to cause movement thereof. A battery for operating the drive motor is connected to a sensor mounted on the handle assembly, with the sensor being capable of connect the battery power to the drive motor. The actuator housing is arranged to allow it to slip over the valve handle and clamp on the valve body without disassembling either the flush valve or the actuator.

48 Claims, 9 Drawing Sheets

U.S. PATENT DOCUMENTS 5,680,879 A * 10/1997 Sheih et al. ..... 4/DIG. 3
5,881,993 A 3/1999 Wilson et al.
5,979,500 A 11/1999 Jahrling et al.
5,984,262 A 11/1999 Parsons et al.
6,000,674 A 12/1999 Cheng
6,056,261 A * 5/2000 Aparicio et al. ..... 251/129.03
6,127,671 A 10/2000 Parsons et al.
6,161,726 A 12/2000 Parsons et al.
6,212,697 B1 4/2001 Parsons et al.
6,216,730 B1 4/2001 Hall
6,293,516 B1 9/2001 Parsons et al.
6,299,127 B1 10/2001 Wilson
6,305,662 B1 10/2001 Parsons et al.
6,349,921 B1 * 2/2002 Jahrling ..... 251/129.04
6,757,919 B2 * 7/2004 Snyder ..... 4/DIG. 3
6,860,282 B2 * 3/2005 Guler ..... 4/DIG. 3

* cited by examiner

AUTOMATICALLY OPERATED HANDLE-TYPE FLUSH VALVE

CROSS REFERENCE TO RELATED APPLICATION

This application is a continuation-in-part of application Ser. No. 09/916,468, filed Jul. 27, 2001, now U.S. Pat. No. 6,643,853.

BACKGROUND OF THE INVENTION

The present invention relates to flush valves of the type commonly used to operate toilets and urinals and more specifically to an actuator which moves a valve handle in either a manual operation or an automatic operation. The flush valve may be a diaphragm-type valve, such as that sold by Sloan Valve Company of Franklin Park, Illinois, under the trademark ROYAL, and which is shown in U.S. Pat. No. 6,216,730, or it may be a piston-type of flush valve sold by Sloan Valve Company under the trademarks GEM and CROWN and shown for example in U.S. Pat. No. 5,881,993.

It is known to use an automatic actuator with a flush valve. Some devices of this type require that the standard manual valve handle be removed and replaced with some sort of electric or hydraulic motor. Such devices are inconvenient and expensive to install, especially if they are used to retrofit standard manual flush valves to automatic operation. Other automatic actuators allow the manual flush valve handle to be retained but the actuators are complicated to install as they require multiple parts or components that must be at least partially disassembled to permit them to be attached to the flush valve. Some automatic actuators provide for automatic operation only, which means if the automatic system becomes inoperative, the entire valve is useless until repairs can be made. Other actuators that do permit either automatic or manual operation are designed such that operation of one type interferes with the components involved in the other type. Battery life, sensor aiming and structural integrity are other areas of concern with prior art automatic actuators.

SUMMARY OF THE INVENTION

The present invention relates to toilet room flush valves and more specifically to an actuator that allows manual or automatic operation of the flush valve.

The present invention is more specifically directed to a combined automatic/manual actuator for a handle-operated flush valve which may be installed without replacing, removing or disassembling any of either the flush valve components or the actuator components. All of the above types of flush valves have a handle which is mounted on the flush valve body for pivotal movement about a handle axis. The actuator of the present invention provides a housing including a handle assembly which adjoins the valve handle. A sensor and a drive motor are mounted in the handle assembly. When sensor action has been initiated, the sensor will connect a battery pack to the drive motor, with the drive motor causing movement of a push rod in the handle assembly. This provides automatic operation of the flush valve by movement of the flush valve handle about its normal or conventional axis. The handle assembly is pivotally movable, independent of the push rod, and may be used to manually operate the handle in the event the automatic system is temporarily inoperative or if a user wishes to initiate a flush apart from a sensor-initiated one.

Of particular advantage in the invention is the fact that the actuator can convert a flush valve from manual only operation to automatic or manual operation. Furthermore, this conversion can be completed through the mounting of a single additional unit on the existing flush valve. Installation does not require removing or altering any components of the flush valve or disconnecting the water supply to the flush valve. And the unit itself need not be opened, disassembled or altered in any way in order to install it. It simply slips directly over the valve handle and is fastened to the flush valve body.

A primary object of the invention is a flush valve actuator as described which may be installed without the removal, disassembly or alteration of any flush valve components or any actuator components and without disconnecting the water supply to the flush valve.

Another object of the invention is an actuator of the type described which mounts on the flush valve body and has a manually-movable handle assembly in which is mounted a motor-driven push rod movable to cause operation of the flush valve handle when such operation is initiated by an automatic sensor.

Still another object of the invention is an actuator as described including a manual override which is pivotally movable independently of the motor-driven push rod.

A further object of the invention is an actuator as described in which the motor-driven push rod is mounted for movement with the manual override.

A still further object of the invention is an actuator as described in which the manual override is stationary during operation of the motor-driven push rod.

Yet another object of the invention is an actuator which is suitable for right or left handle operation.

Another object of the invention is an actuator as described in which the motor-driven push rod when at rest has some slack between the valve handle and the drive motor so the motor current upon start up is reduced, thereby significantly increasing battery life.

Another object is an actuator as described in which the handle assembly includes a handle interface that contacts the flush valve handle when the unit is at rest so the motor-driven push rod is not loaded during a manual actuation of the handle assembly.

A further object is an actuator having a housing that transfers any mechanical loads on the unit to the flush valve body without loading the motor-driven drive train, the handle assembly or the fasteners holding the actuator together.

Still another object is an actuator as described having the sensor mounted as close as possible to the vertical centerline of the flush valve so it can sense the presence or absence users.

A still further object is an actuator as described that can be applied to flush valves having any style handle, whether long, short or otherwise.

Other objects will appear in the ensuing specification, drawings and claims. These and other desired benefits and objects of the invention, including combinations of features thereof, will become apparent from the following description. It will be understood, however, that a device could still appropriate the claimed invention without accomplishing each and every one of these desired benefits, including those gleaned from the following description. The appended claims, not these desired benefits, define the subject matter of the invention.

DETAILED DESCRIPTION OF THE INVENTION

Figure 1:
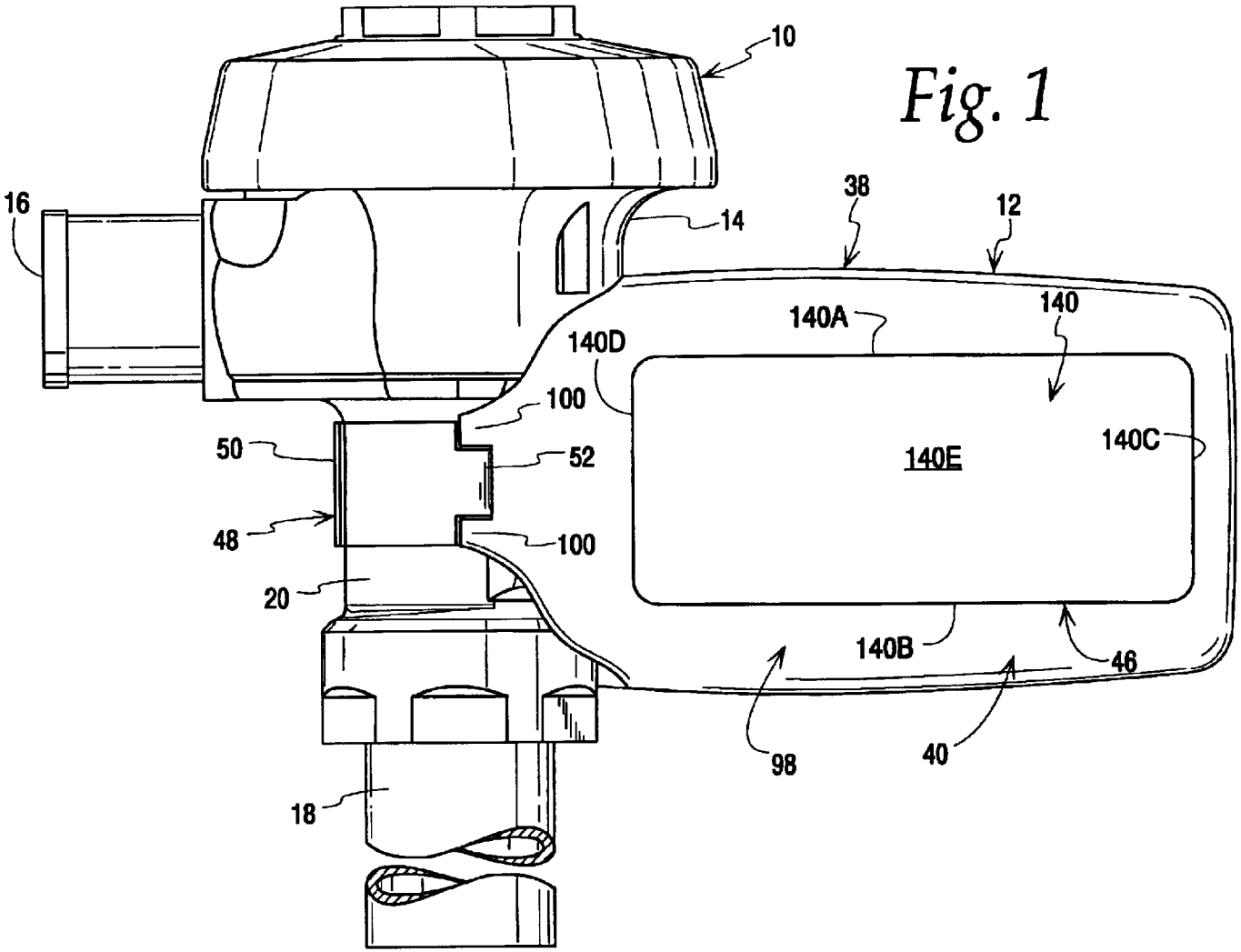
FIG. 1 is a front elevation view of a flush valve with the actuator of the present invention mounted thereon.
Figure 2:
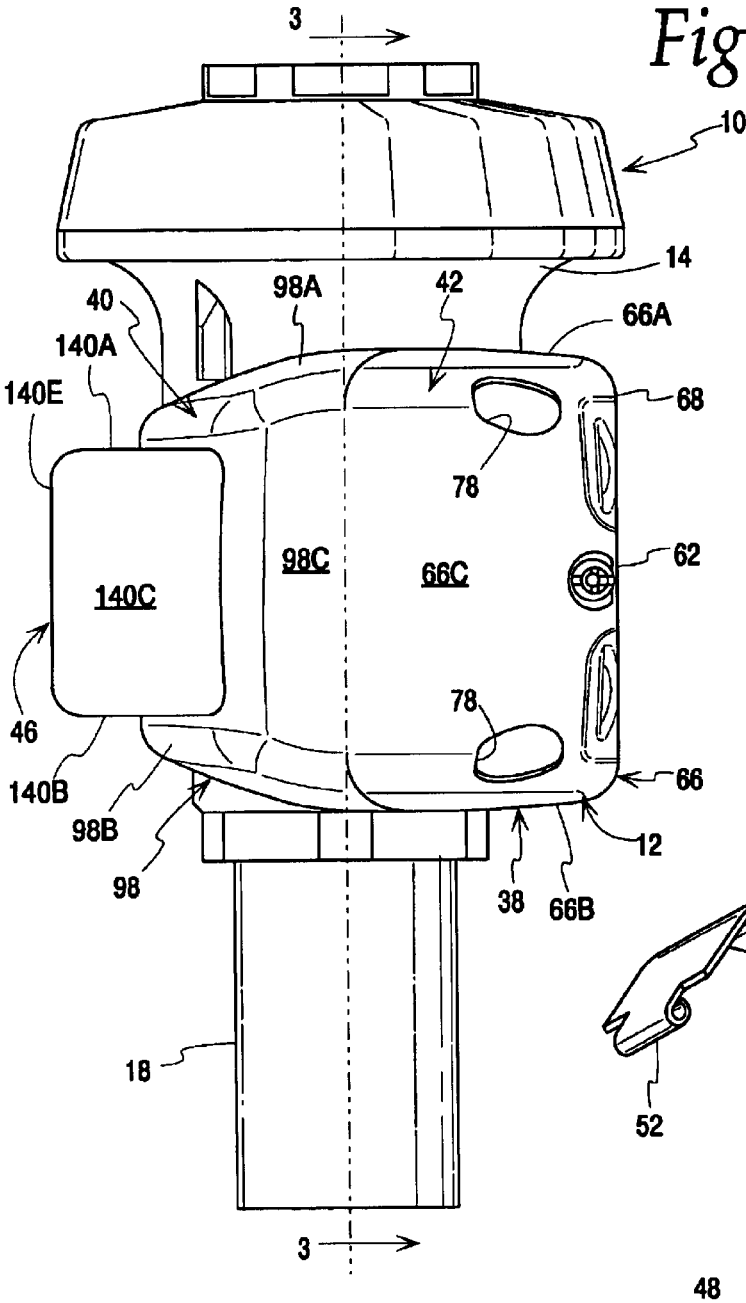
FIG. 2 is a right side elevation view of the actuator mounted on a flush valve.

The present invention relates to an actuator that may be attached to a toilet room flush valve so that it may be operated either automatically by means of a sensor or manually by means of a handle assembly. The flush valve may be of the diaphragm type or of the piston type. A diaphragm-type flush valve is shown in U.S. Pat. No. 5,967,182, the disclosure of which is herein incorporated by reference, and is sold by Sloan Valve Company, the assignee of the present application, under their trademark ROYAL. The piston-type flush valve may be of the type shown in U.S. Pat. No. 5,881,993, the disclosure of which is herein incorporated by reference, and may be sold by Sloan Valve Company under their trademarks GEM or CROWN.

The actuator utilizes a sensor, which may be of the infrared type, and is preferably battery powered. The sensor may be as shown in U.S. Pat. No. 6,161,814, also owned by Sloan Valve Company, and the disclosure of which is herein incorporated by reference. Sensor-operated, battery powered flush valves are known in the art from the '261 patent and others. The present invention utilizes the technology in the '261 patent or similar technologies for infrared operation of a flush valve which may be of the types described in the above-referenced patents. The particular disclosure shown herein illustrates a valve of the ROYAL type.

Looking at FIGS. 1–4, the flush valve is shown generally at 10 and mounted thereon is the actuator 12 of the present invention. The flush valve has a body 14 which includes a water inlet 16, a water outlet 20 and a vacuum breaker 18 beneath the outlet. A handle opening 22 (FIG. 3) in the water outlet is surrounded by a laterally-extending, annular boss 24 which is externally threaded. Inside the valve body 14 there is either a movable diaphragm or a piston (not shown) which will control the flow of water between the inlet 16 and the outlet 18 in the conventional manner. The diaphragm or piston has associated with it the usual relief valve whose depending stem (not shown) extends to a point opposite the handle opening 22.

A valve handle 26 is mounted to the boss 24 by a handle mounting member. In this case the handle mounting member includes a handle socket 28. The handle socket has a generally cylindrical cup 30 and an end face formed by a flange 32. A lip on the opposite end of the cup is trapped by a coupling nut 34. The coupling nut is threaded to the boss 24. The valve handle 26 is pivotally movable about a three dimensional pivot when the handle is used to cause operation of the flush valve. A shank 35 inside the handle socket 28 captures the inner end of the valve handle 26. A plunger 36 joins the shank and extends into the valve body where it can act on the relief valve stem. Tilting of the valve handle 26 causes movement of the shank 35 and plunger 36 that in turn trips the relief valve and begins a flushing cycle. The parts and operation described thus far are all conventional.

The primary components of the actuator 12 of the present invention include a housing and a handle assembly. The housing, shown generally at 38, is preferably a three-part structure that includes a front cover 40, a rear cover 42, and a handle collar 44. Screws fasten the front and rear covers together, with the handle collar disposed between them. The housing defines a receptacle for the valve handle 26, with the handle collar providing an abutment that mates with the end face of the handle socket 28. The handle assembly is shown generally at 46. It is pivotally mounted on bearings formed in the housing 38. An interior portion of the handle assembly resides within the housing while an exterior portion extends through an opening in the front cover to the outside of the housing. One aspect of the present invention is that the motor and drive train used to effect automatic operation of the flush valve are mounted in the handle assembly 46, as will be described in detail below. This arrangement affords a compact package for the actuator. Another aspect of the invention is the simple and efficient manner in which the actuator can be attached to a flush valve. Neither the flush valve nor the actuator has to be disassembled or altered in any way in order to mount the actuator on the flush valve. The actuator simply slips over the valve handle and into operative engagement therewith. This is made possible by the housing receptacle and a mounting strap 48.

Figure 6:
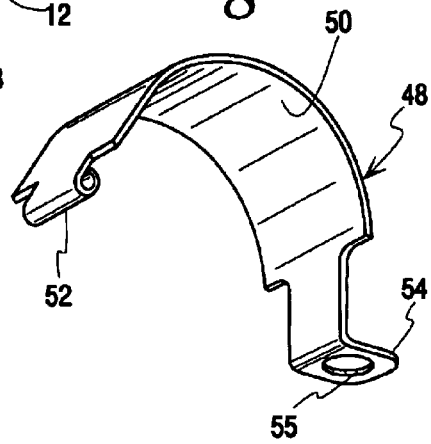
FIG. 6 is a perspective view of the mounting strap.
Figure 7:
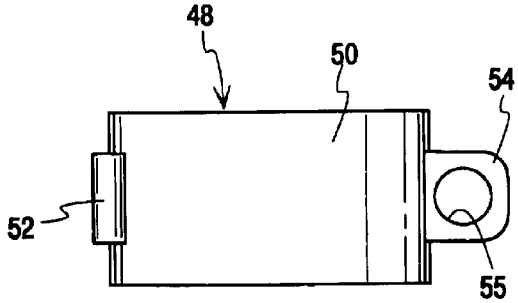
FIG. 7 is a side elevation view of the mounting strap.
Figure 3:
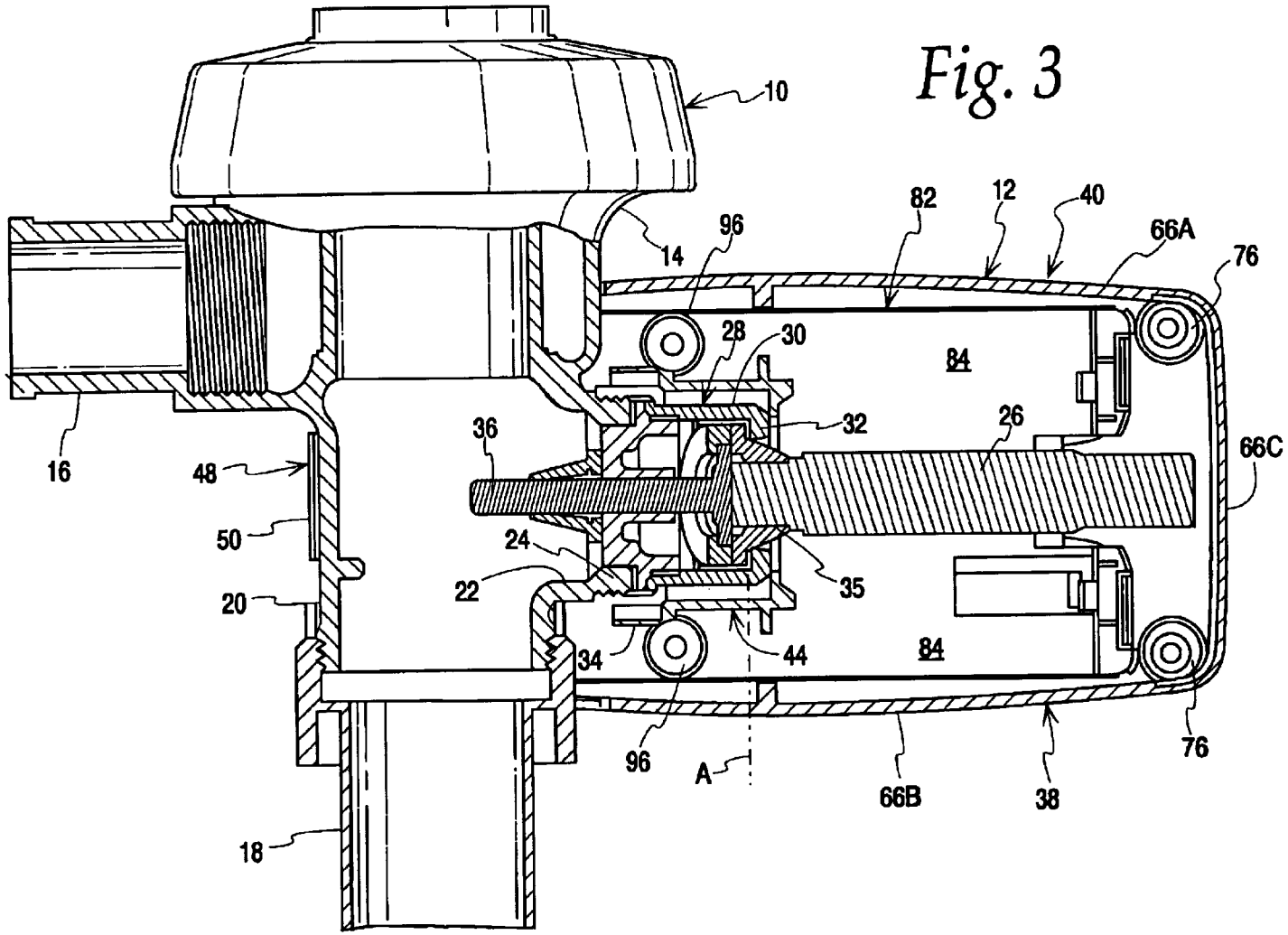
FIG. 3 is a section taken along line 3—3 of FIG. 2.
Figure 5:
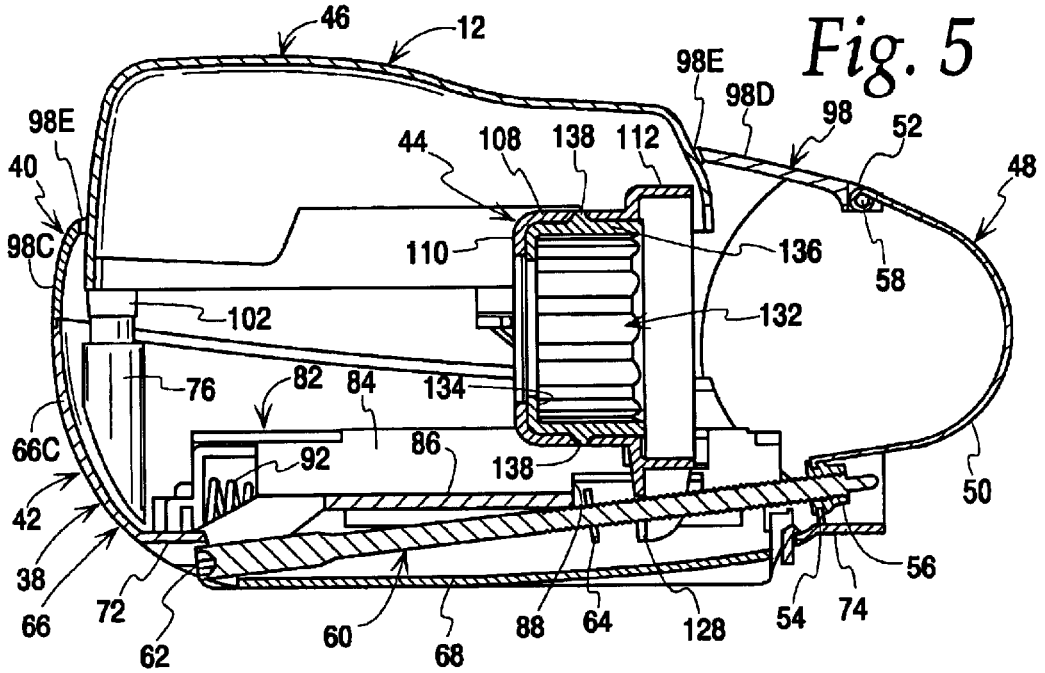
FIG. 5 is a section taken along line 5—5 of FIG. 4.

Details of the mounting strap 48 are shown in FIGS. 5–7. The strap includes an arcuate body portion 50 bounded on one end by a hinge sleeve 52 and on the other end by a folded back tab 54. The tab has an aperture 55 which receives an internally threaded clinch nut 56 (FIG. 5). An end portion of the clinch nut fits through the aperture 55 and is crimped to the tab. The hinge sleeve 52 has a pin hole through it. The hinge sleeve 52 fits between a pair of ears on the front cover 40. The ears also have pin holes which align with that of the sleeve 52. A hinge pin 58 (FIG. 5) fits through the pin holes to pivotally attach the strap to the front cover. The body portion 50 wraps around the water outlet 20 of the valve body as seen in FIGS. 1 and 3. At the rear cover the clinch nut 56 is threadedly engaged by a mounting screw 60. The mounting screw is rotatably fixed in the rear cover. It has a head 62 protruding from the rear cover wnere it can be tightened or loosened by a screwdriver. Preferably the screw head will accept either Phillips or straight screwdrivers. A retaining ring 64, which can be a simple rubber O-ring, captivates the mounting screw in the rear cover and prevents it from falling out of the rear cover.

Figure 4:
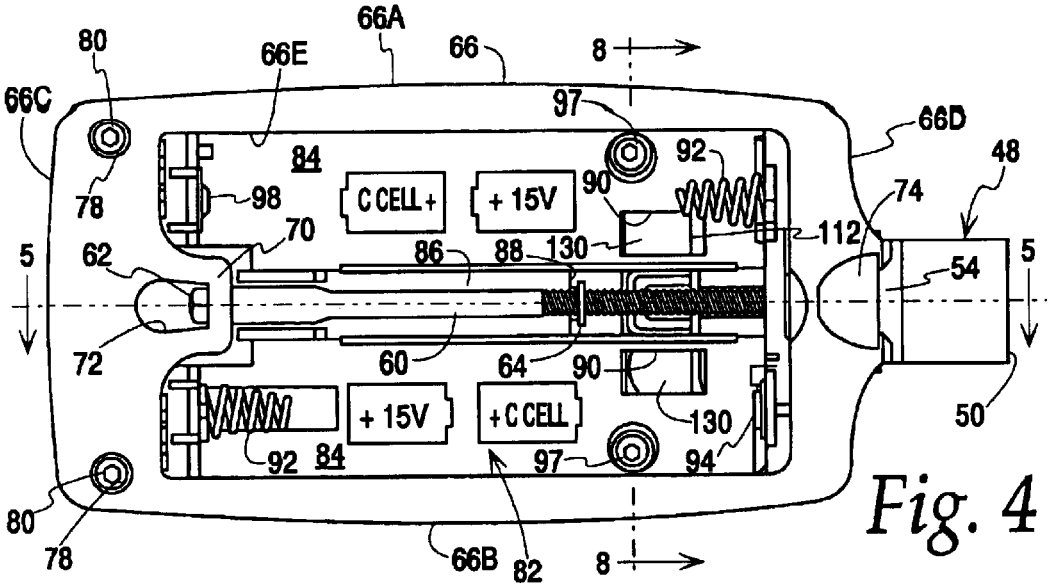
FIG. 4 is a rear elevation view of the actuator with the battery hatch cover removed to show the interior of the rear cover.

The installation procedure for the actuator is as follows. With the body of the mounting strap 48 pivoted away from the centerline of the actuator, the housing 38 is moved laterally over the free end of the valve handle 26 in a direction parallel to the axis of the handle. This movement continues until the collar mounting grommet 134 surrounds the handle socket and the handle collar 44 abuts the end face 32 of the handle socket 28. Then the body 50 of the strap 48 is pivoted around the water outlet 20 of the flush valve. The clinch nut 56 is aligned with the end of the mounting screw 60 so the screw may be threaded into the nut. Turning the screw tightens the strap about the water outlet 20. The actuator is clamped onto the body of the valve. Only one tool is required. There are no loose, dangling or separate parts for the installer to deal with. Nothing has to be removed or disassembled on either the actuator or flush valve. Installation is quick and so straightforward it can be performed by personnel of any skill level. Turning now to a discussion of the housing 38, the rear cover 42 is shown in FIGS. 2–5 and 8. The rear cover has an outer shell 66 including generally horizontal top and bottom walls 66A, 66B, a curved distal end wall 66C and a proximal end wall 66D. The inside edges of these walls define a large battery access hatch 66E (FIG. 4). A battery hatch cover 68 (FIG. 5) has tabs on its ends that engage the end walls in a snap fit. The inside edge of the distal end wall 66C has an extension 70 having a hollow recess 72 on its outer surface. The recess defines a wall 73 (FIG. 16) with a bore therethrough which receives the mounting screw 60. The retaining ring 64 on the inside of the extension may cooperate with the wall in the extension or with the web 86 in the tray 82 to captivate the mounting screw in the rear cover. The other end of the mounting screw extends to an upset portion 74 on the proximal end wall 66D. At the corners where the distal end wall 66C meets the top and bottom walls 66A, 66B there are upper and lower mounting posts 76 on the inside of the shell which cooperate with recesses 78 on the outside of the shell. Self tapping screws 80 whose heads are in the recesses 78 and whose shanks extend through bores in the mounting posts 76 fasten the rear cover to the front cover 40, as will be explained more fully below.

Figure 8:
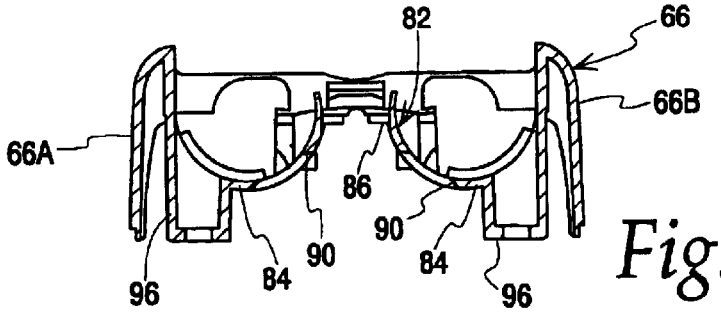
FIG. 8 is a section through the rear cover, taken along line 8—8 of FIG. 4.
Figure 9:
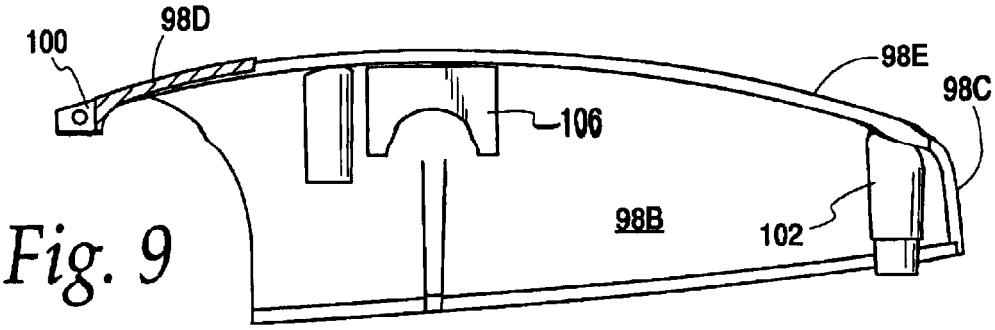
FIG. 9 is a section through the front cover taken on a horizontal plane, similar to line 5—5 of FIG. 4.
Figure 10:
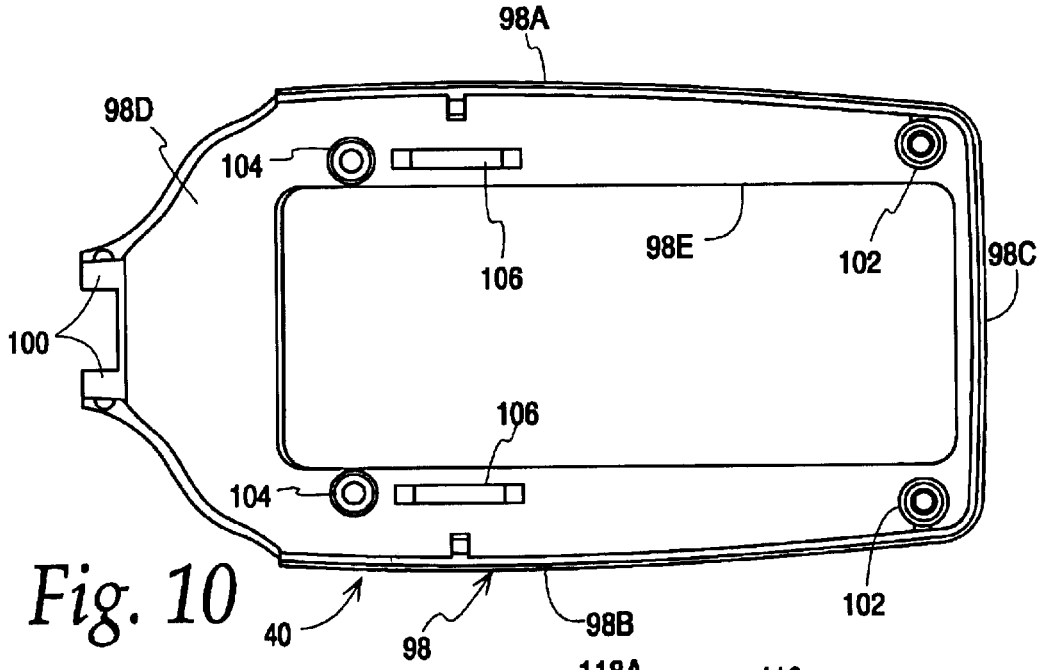
FIG. 10 is a rear elevation view of the front cover, looking at the interior of the cover.
Figure 11:
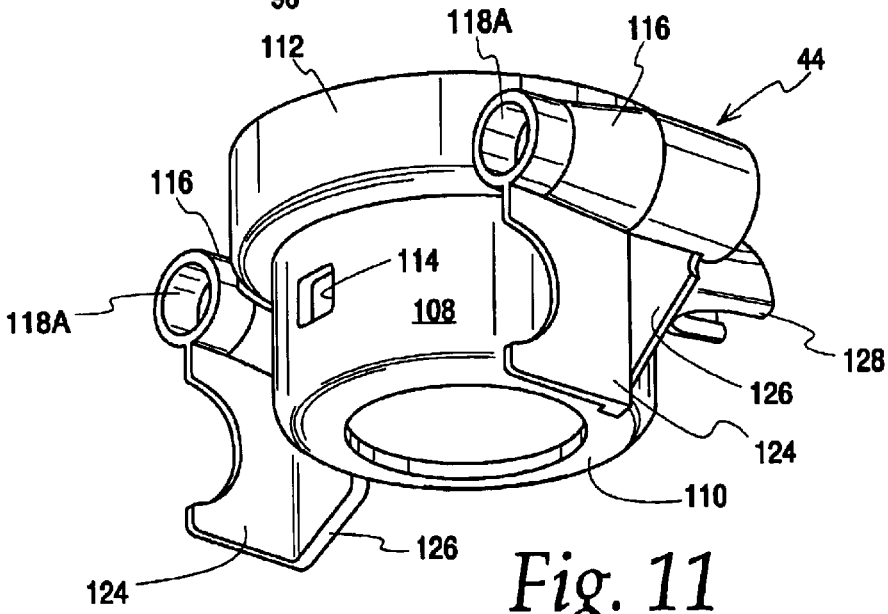
FIG. 11 is a perspective view of the handle collar.
Figure 12:
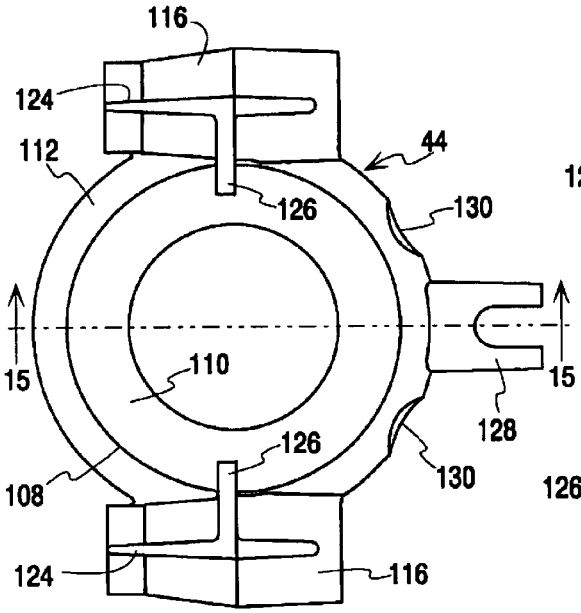
FIG. 12 is a right side elevation view of the handle collar.
Figure 13:
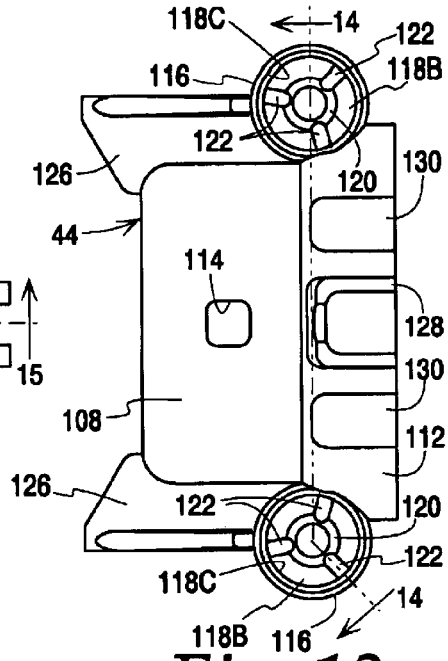
FIG. 13 is a rear elevation view of the handle collar.
Figure 15:
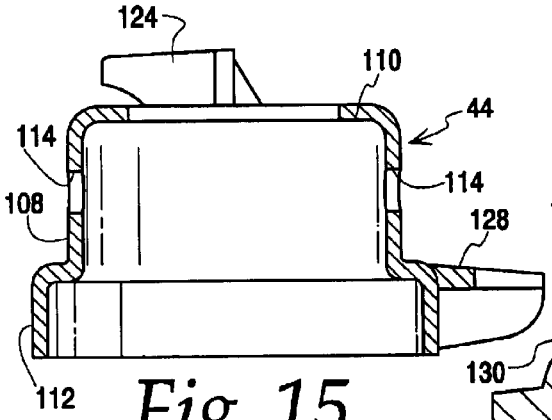
FIG. 15 is a section taken along line 15—15 of FIG. 12.
Figure 17:
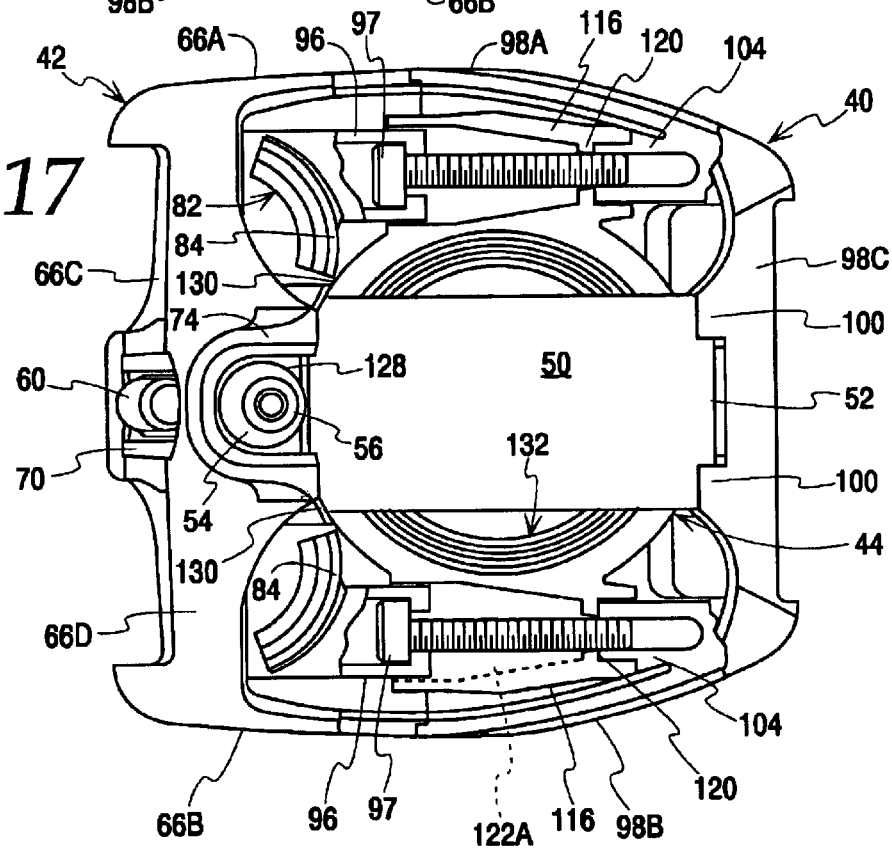
FIG. 17 is left end elevation view of the actuator assembly, with parts shown schematically in section to illustrate the mating of the housing components. In this figure one of the lower torpedo tube projections is shown rotated out of its actual position for the purpose of illustrating the telescopic connection of the rear cover pillars and the torpedo tubes.
Figure 18:
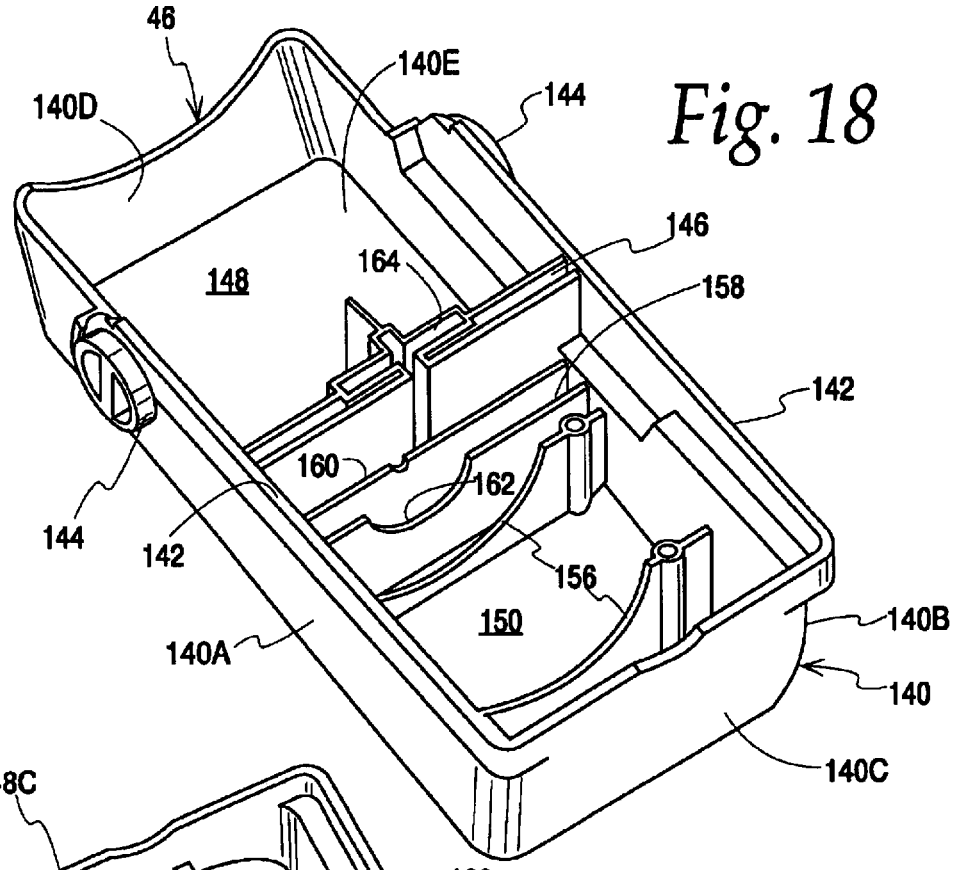
FIG. 18 is a perspective view of the interior of the handle assembly with the electronics package and drive train removed to show only the case and its internal walls.

The interior of the shell 66 houses a tray 82. The tray is made of two U-shaped troughs 84 connected by a central web 86. The web has a slot 88 that permits passage of the mounting screw 60. The troughs each have a cutout 90 near the proximal wall 66D for receiving a portion of the handle collar 44. Opposite ends of the troughs 84 mount a battery contact spring 92, while the other ends carry battery contact clips 94. The troughs are sized to support two C-sized batteries end to end. On the convex side of the troughs there are upper and lower mounting pillars 96. These engage the torpedo tubes of the handle collar 44 as will be explained below. As seen in FIG. 8 the pillars are hollow with end walls having bores therethrough. FIGS. 4 and 17 show the mounting screws 97 that fit in the bores of the pillars to join the front and rear covers with the handle collar between. Details of this connection are shown below.

Details of the front cover 40 are shown in FIGS. 1, 2, 5, 9–10 and 16. The front cover has a shell 98, somewhat similar in shape to the shell 66, which has top and bottom walls 98A, 98B, a distal end wall 98C and a proximal end wall 98D. The inside edges of these walls define a large handle assembly opening 98E. The proximal end wall 98D has a pair of ears 100 formed thereon. As described above, ears 100 cooperate with the mounting strap sleeve 52 to form a hinge that joins the mounting strap 48 to the front cover 40. At the corners where the distal end wall 98C meets the top and bottom walls 98A, 98B there are upper and lower mounting posts 102 on the inside of the shell 98. These posts have bores which receive the screws 80 to fasten the distal ends of the front and rear covers together. The bores in posts 102 do not extend through to the front of the shell. Near the proximal end wall 98D there are upper and lower mounting pillars 104. These engage the torpedo tubes of the handle collar as will be explained below. The pillars 104 are hollow but the bores therein do not extend through to the front of the shell 98. Upper and lower saddles 106 have semi-circular cutouts in their free edges. The saddles cooperate with similar structures on the handle collar to form bearings on which the handle assembly pivots.

Figure 14:
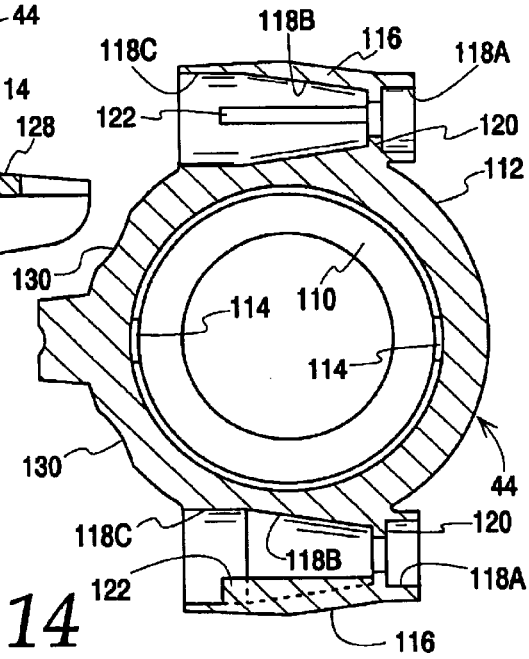
FIG. 14 is a section taken along line 14—14 of FIG. 13.

Turning now to FIGS. 11–15, details of the handle collar 44 are shown. The collar has a cylindrical sleeve 108 bounded at its distal end by a radially-extending flange 110 and at its proximal end by an annular ring 112 of enlarged diameter. The sleeve 108 has a pair of central apertures 114 which receive tabs on a grommet as will be explained later. Near the junction between the ring and sleeve are upper and lower torpedo tubes 116. As seen in FIG. 14 the torpedo tubes each has a cavity extending through. Each cavity includes a front portion 118A, a conical central portion 118B and a rear cylindrical portion 118C. The front and central portions are divided by a partition 120 which has an aperture in it. Three projections 122 extend radially into the cavity and axially from the partition partially onto the rear portion cutout in its front edge. Saddles 124 cooperate with the saddles 106 on the front cover to form bearings for the handle assembly. The saddles are reinforced by gussets 126. The ring 112 further includes a channel-shaped guide member 128 that has a U-shaped cutout in one face for receiving the mounting screw 60. An additional feature of the ring 112 is a pair of depressions 130 (FIG. 12) that fit in the cutouts 90 in the rear cover tray 82. The axial extent of the ring is such that the ring fits through the cutouts. The depressions maintain the concave profile of the troughs 84 so the batteries will lie flush against the troughs.

FIG. 5 illustrates another component of the handle collar. A collar mounting grommet 132 fits inside the sleeve 108 of the collar 44. The grommet includes a flange 134 and a ribbed skirt 136. The skirt has locating tabs 138 which extend into the apertures 114 in the sleeve 108. The flange 134 adjoins the flange 110 of the collar. The grommet is made of a pliant material such as rubber or a rubber compound.

Figure 16:
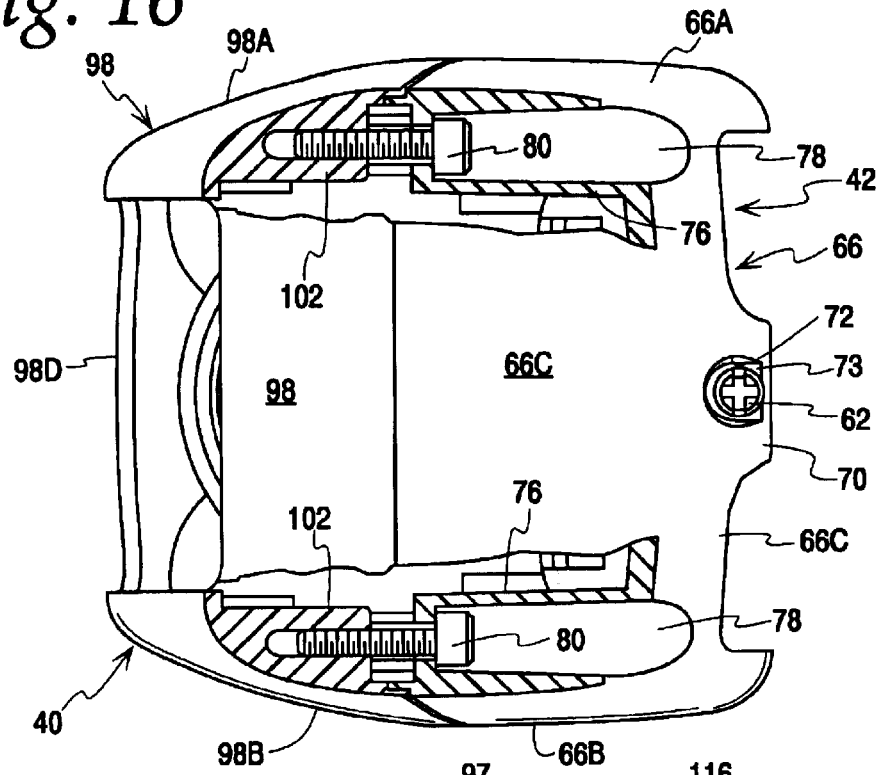
FIG. 16 is a right end elevation view of the actuator assembly, with parts shown schematically in section to illustrate the mating of the housing components.

FIGS. 16 and 17 illustrate how the housing components fit together and are held fast to one another. In FIG. 16 it can be seen that the ends of the upper and lower mounting posts 76 abut the facing ends of the front cover mounting posts 102. Screws 80 have heads that fit in the recesses 78. The threads of the screws engage the inside surface of the bores in posts 102. FIG. 17 illustrates the telescoping engagement of the rear cover pillars 96, the front cover pillars 104 and the torpedo tubes 116. Specifically, the rear cover pillars 96 fit inside the rear cavities 118C of the torpedo tubes 116 to a depth permitted by the cavity projections 122. One of the projections in the lower torpedo tube is shown in phantom at 122A rotated from its true position to illustrate how the ends of the projections limit the penetration of the rear pillars 96 into the tubes 116. On the front side of the tubes the pillars 104 fit inside the front cavity portions 118A to the extent permitted by the partitions 120. Mounting screws 97 fit in the bores of the rear pillars 104 with the screw heads in contact with the end walls of the pillars. The shanks of the screws pass through the central cavity portions 118B and the partitions 120 without engaging them. The screw threads engage the inner walls of the front cover pillars 104. The telescoping engagement of the covers 40, 42 and the collar 44 automatically aligns these three components. It also transfers all mechanical loading on the housing covers to the collar, which in turn transfers such loads to the valve body. All abusive loads applied to the housing end up directly on the collar. Furthermore, it is important that the structural members, namely the pillars and torpedo tubes, bear these loads, not the mounting screws 80, 97 and their associated threads. This provides a more secure mounting for the actuator.

Turning now to consideration of the handle assembly 46, this component, much like the front and rear covers has a generally five-side shell or case 140. External features of the case are visible in FIGS. 1 and 2. These include a top wall 140A, a bottom wall 140B, a distal end wall 140C and a proximal end wall 140D. The case also has a front wall 140E. The remaining features of the handle assembly will be described in conjunction with FIGS. 18–21. The top and bottom walls 140A, 140B each have a longitudinally extending ledge 142. The ledge is engageable with the interior edges of the front cover walls about the large opening 98E. This engagement prevents the handle assembly from coming completely out of the housing. Toward the proximal end of the case 140 the ledges 142 mount top and bottom stubshafts 144. The stubshafts are held between the saddles 106 of the front cover and the saddles 124 of the handle collar to mount the case 140 for pivoting motion about a vertical axis. The pivot axis is close to the pivot axis A (FIG. 3) of the valve handle 26.

The interior of the case is divided by a double wall partition 146. This partition defines an electronics compartment 148 and a drive train compartment 150 in the case 140. The electronics compartment contains suitable mounting locations for a printed circuit board which is shown schematically at 152 in FIG. 20. This board will include a sensor 154 and associated electronics for detecting a user near the flush valve. The board is electrically connected to the battery terminals 92, 94. The front wall 140E has a window portion 140F (FIG. 20) which is transparent to the signals for the sensor. It will be understood the window may be opaque to visible light but allow other types of electromagnetic energy, e.g., infrared light, to pass freely.

The drive train compartment 150 incorporates several structures for mounting drive train components. These include a pair of motor mounts 156 having semi-circular cutouts therein. First and second panels 158, 160 define a cam chamber between them. The first panel 158 has an arcuate cutout 162 for receiving the cam drive gear. A guide channel 164 is formed in the partition 146.

Figure 19:
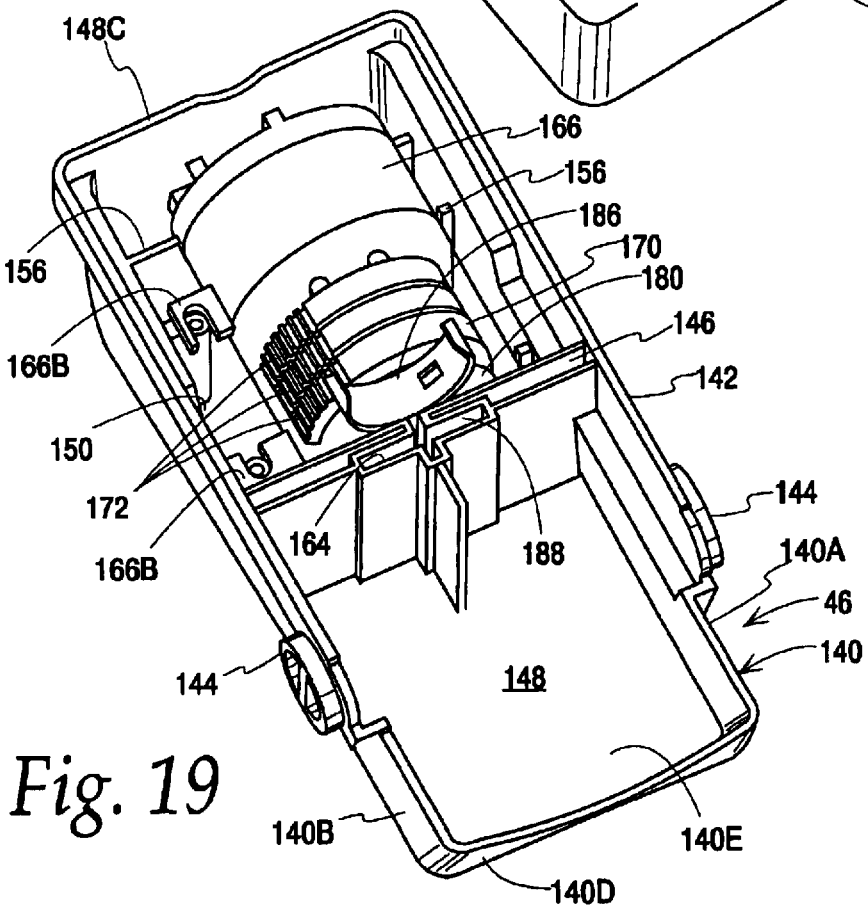
FIG. 19 is a perspective view of the interior of the handle assembly with the electronics package removed to show drive train.
Figure 20:
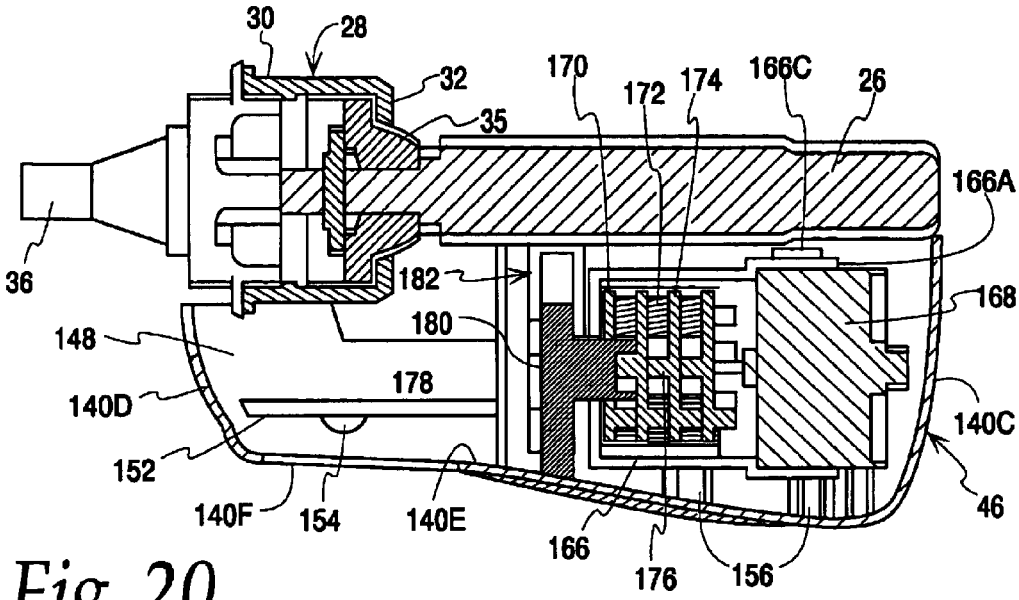
FIG. 20 is a horizontal section of the handle assembly and valve handle, taken through the centerline of the motor shaft, with the electronics package shown schematically.
Figure 21:
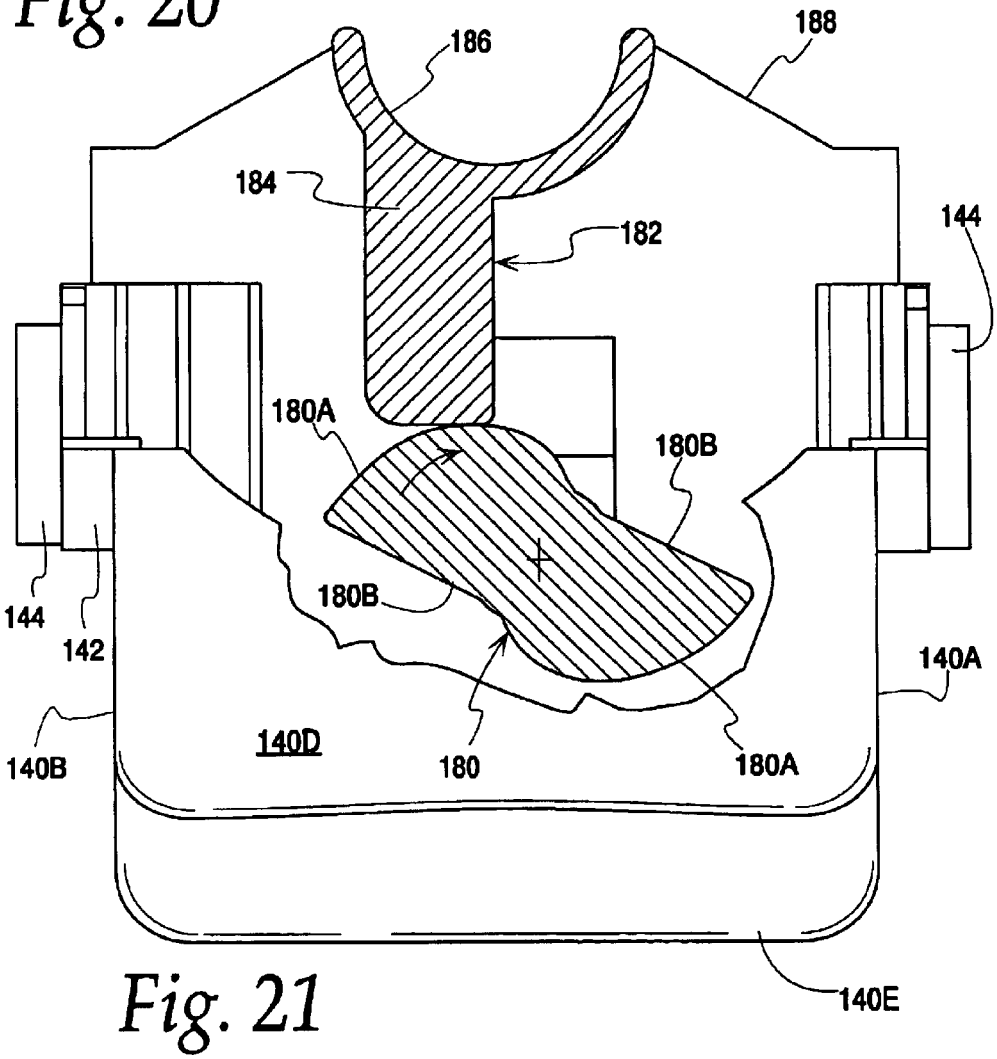
FIG. 21 is a left end view, on an enlarged scale, of the handle assembly, with the cam and push rod shown in schematic section to highlight these parts.

The drive train itself is shown in FIGS. 19–21. It includes a mounting tube 166. This is a generally cylindrical tube with an enlarged portion 166A near its open end. The tube rests in the cutouts of the motor mounts 156. Brackets 166B on the exterior of the tube 166 allow the tube to be screwed to posts built in to the motor mounts. The exterior of the tube also has an interface or pad 166C which is sized and located to be in engagement with the valve handle 26 when the drive train is inactive. The enlarged portion 166A of the tube receives an electric motor 168 therein. The motor is, of course, electrically connected to the printed circuit board 152 for control by the electronics thereon. The output shaft of the motor is connected to a planetary gear train. In the illustrated embodiment this is a three-stage planetary drive but it will understood that different numbers of stages could be used. Indeed, other types of gear trains could be substituted for the planetary drive so long as they provide the necessary speed reduction and torque. The planetary drive shown includes a fixed ring gear 170 in the closed end of the mounting tube 166. The ring gear has internal teeth on its inner surface. These teeth mesh with those of plural planetary gears 172 which are mounted on carriers 174 the usual sun gears 176 on the centerline of the motor shaft. The output of the planetary gear train is an externally splined shaft which engages the internal splines of a cam drive gear 178. This gear is fixed to a cam 180. The gear 178 is supported by the arcuate cutout 162 in the first panel 158. A cam shaft (not shown) attached to the cam 180 on the side opposite gear 178 is mounted for rotation on the second panel 160. The cam in this embodiment includes two lobes, each having a curved actuating surface 180A and a neutral surface 180B. Different numbers of lobes could be used. The cam is operatively engageable with a push rod shown generally at 182. The push rod is preferably an integral member which includes a cam follower 184, an arcuate shoe 186 and a guide plate 188. The push rod is mounted for linear motion in a horizontal plane. The guide plate 188 is slidably mounted in the guide channel 164 and constrains the push rod to linear motion. The shoe 186 is engageable with the valve handle 26 to impart a pivoting motion thereto when the motor 168 is activated by the sensor 154.

It is important that the drive train have some slack between the motor and the valve handle. This can be achieved by spacing the surface of the push rod's shoe 186 slightly from the valve handle when the motor is at rest. Or the cam actuating surface 180A might be spaced slightly from the follower 184 when the motor is at rest. Or there might be a combination of these two. Leaving some slack in the drive train will significantly increase battery life by allowing the gear train to begin movement while not under resistance from the valve handle. This no-load startup movement lasts only an instant but it is enough to get the entire drive train moving before encountering resistance from the valve handle. Another benefit to having slack in the drive train while at rest is when a manual actuation of the handle assembly 46 occurs the drive train experiences no load at all. It simply goes along for the ride with the case 140. Using separate structures to effect the automatic and manual actuation increases the life of the drive train components.

The use, operation and function of the actuator are as follows. The installation of the actuator was described above. Once installed the unit can activate the flush valve 10 either automatically or manually. Automatic operation occurs when the sensor 154 detects a condition calling for a flush cycle. The sensor turns on the motor 168. The motor shaft turn the first sun gear 176 causing the planetary gears 172 and carriers 174 of the drive stages to rotate, ultimately resulting in rotation of the output shaft and the cam drive gear 178. The cam drive gear rotates the cam 180, causing its actuating surface 180A to engage the end of the cam follower 184, as seen in FIG. 21. The cam rotates in a clockwise direction as seen in FIG. 21. The cam surface 180A drives the push rod 182 to the left, i.e., toward the valve handle 26. After the slack between the in the drive train is taken up, the push rod causes a pivoting motion of the valve handle 26 about its axis A. This initiates the flush cycle of the valve 10 in the usual manner. When the cam surface 180A slides past the follower 184 the neutral surface 180B is parallel to the follower. A feedback switch (not shown) turns off the motor. The return spring in the valve that acts on the valve handle causes the valve handle to return to its rest position, which also moves the push rod 182 back to its rest position. Once the valve completes its flush cycle and the electronics resets, the valve is ready for the next operation.

If the automatic system is inoperative for some reason, e.g., dead batteries, or if a user wishes to flush the fixture separate from the normal time programmed into the electronics, the valve can be flushed manually as follows. The user presses on the front wall 140E of the handle assembly 46 toward the rear of the unit. This causes the entire case 140 to pivot about the stubshafts 144. Since the mounting tube pad 166C is already engaged with the valve handle 26, this immediately causes a pivoting motion of the valve handle. Sufficient movement opens the flush valve at which point the user removes pressure from the handle assembly. The valve handle return spring causes the valve handle and the case 140 to return to their normal, non-actuated positions. Even if the user doesn't release the case, the plunger 36 disconnects from the relief valve, allowing the flush valve to cycle normally, as is conventional.

One of the advantages of the present invention is the arrangement of the compartments in the case 140. It will be noted that the electronics compartment 148 is closer to the proximal end than the drive train compartment. This locates the sensor 154 closer to the centerline of the valve body which in turn makes it much more likely that the sensor will have the user in its field of view. No special optics or aiming of the sensor need be provided with the electronics located as described.

Of particular importance in the invention is the fact that the actuator assembly may be mounted on the flush valve without removing, loosening or otherwise altering any flush valve components or actuator components. Neither is disconnecting the water supply necessary. Once the batteries are installed, the actuator simply slides over the end of the handle until the flanges 134 and 110 of the grommet 132 and handle collar 44 contact the end face of the handle socket 28. Then the mounting strap is wrapped around the water outlet 20 of the valve body and the mounting screw is tightened in the clinch nut 56. This clamps the actuator on to the end face of the handle mounting member. It will be understood that the term handle mounting member is intended to encompass any structure surrounding the valve handle, whether it be the socket 28, the coupling nut 34 or some alternate component that provides a solid mounting point for the collar. Alternate valve body constructions might make the body itself the component most available for clamping engagement with the actuator. All of these possibilities are within the contemplated scope of the invention.

While reference has been made herein to the advantages of the invention in retrofitting or converting manually-operated flush valves to automatic/manual operation, it will be understood that the actuator is not just for retrofitting previously-installed valves. New valves of standard construction can also benefit from the actuator of the present invention.

Whereas the preferred form of the invention has been shown and described herein, it should be realized that there may be many modifications, substitutions and alterations thereto. For example, while battery power is shown and preferred to make the unit self-contained, it would be possible to connect an external power supply.

What is claimed is:

1. In a toilet room flush valve for use in flushing toilets and urinals including a valve body having a water inlet and a water outlet, valve means within the body for controlling flow between the inlet and outlet, and a valve handle pivotally mounted on the valve body for movement to operate the valve means, the improvement comprising an actuator for causing movement of the valve handle, the actuator comprising:

a housing mountable on the valve body, a handle assembly pivotally mounted to the housing, a push rod mounted for movement with the handle assembly and relative to the handle assembly, the push rod being positioned to be engageable with the valve handle, an interior space formed between the valve handle and said handle assembly, a drive motor mounted in said interior space and connected to the handle assembly and connected to the push rod to cause movement thereof, a power supply for operating the drive motor, and a sensor associated with the actuator and connected to the power supply to cause the application of power to the drive motor, the handle assembly being engaged with the valve handle for causing pivotal movement of the handle independent of the push rod.

2. The actuator of claim 1 wherein the handle assembly includes a handle interface which engages the valve handle when the drive motor is not activated.

3. The actuator of claim 2 wherein the push rod has some slack between the valve handle and the drive motor when the drive motor is not activated.

4. The actuator of claim 1 wherein the push rod has some slack between the valve handle and the drive motor when the drive motor is not activated.

5. The actuator of claim 1 wherein the housing comprises a front cover, a rear cover and a handle collar, the handle collar being engageable with the valve body and the front and rear covers being fixed to the handle collar.

6. The actuator of claim 5 wherein the handle collar includes at least one torpedo tube, and one of the front and rear covers includes at least one pillar in telescoping engagement with the torpedo tube.

7. The actuator of claim 6 wherein the other of the front and rear covers includes at least one pillar in telescoping engagement with the torpedo tube.

8. The actuator of claim 1 wherein the flush valve further comprises a handle mounting member surrounding the valve handle and having an end face which is in a plane generally perpendicular to the valve handle, and the housing further comprises a handle collar engageable with the end face of the handle mounting member, and a mounting strap releasably connected to the housing and engageable with the valve body to clamp the housing to the end face of the handle mounting member.

9. The actuator of claim 8 wherein the handle mounting member is a handle socket.

10. The actuator of claim 9 wherein the handle socket includes a cup and the end face is a flange on one end of the cup, the handle collar further comprising a sleeve that fits over the cup and a flange that is engageable with the flange of the socket.

11. The actuator of claim 10 wherein the handle collar further comprises a flexible grommet.

12. The actuator of claim 1 wherein the handle assembly includes a case having a drive train compartment and an electronics compartment.

13. The actuator of claim 12 wherein the electronics compartment contains the sensor and is located such that when the actuator is mounted on a flush valve, the electronics compartment is closer to the valve body than the drive train compartment.

14. The actuator of claim 1 wherein the sensor is mounted on the handle assembly.

15. An actuator for operating the valve handle of a flush valve either manually or automatically, the actuator including a housing mountable on the valve body, a manually operable handle assembly pivotally mounted on the housing and engageable with the valve handle for pivoting the valve handle upon manual actuation of the handle assembly, a push rod engageable with the valve handle, an interior space formed between the valve handle and said handle assembly, a motor-driven push rod mounted in said interior space and connected to on the handle assembly and positioned to contact and pivotally move the valve handle, a drive motor connected to the push rod to cause movement thereof, a power supply for operating the drive motor, and a sensor electrically connected to the power supply for applying power to the drive motor to cause movement of the valve handle upon sensing a condition that calls for operation of the flush valve, the handle assembly being engaged with the valve handle for causing pivotal movement of the handle independent of the push rod.

16. The actuator of claim 15 wherein the handle assembly includes a handle interface which engages the valve handle when the drive motor is not activated.

17. The actuator of claim 16 wherein the push rod has some slack between the valve handle and the drive motor when the drive motor is not activated.

18. The actuator of claim 15 wherein the push rod has some slack between the valve handle and the drive motor when the drive motor is not activated.

19. The actuator of claim 15 wherein the housing comprises a front cover, a rear cover and a handle collar, the handle collar being engageable with the valve body and the front and rear covers being fixed to the handle collar.

20. The actuator of claim 19 wherein the handle collar includes at least one torpedo tube, and one of the front and rear covers includes at least one pillar in telescoping engagement with the torpedo tube.

21. The actuator of claim 20 wherein the other of the front and rear covers includes at least one pillar in telescoping engagement with the torpedo tube.

22. The actuator of claim 15 wherein the flush valve further comprises a handle mounting member surrounding the valve handle and having an end face which is in a plane generally perpendicular to the valve handle, and the housing further comprises a handle collar engageable with the end face of the handle mounting member, and a mounting strap releasably connected to the housing and engageable with the valve body to clamp the housing to the end face of the handle mounting member.

23. The actuator of claim 22 wherein the handle mounting member is a handle socket.

24. The actuator of claim 23 wherein the handle socket includes a cup and the end face is a flange on one end of the cup, the handle collar further comprising a sleeve that fits over the cup and a flange that is engageable with the flange of the socket.

25. The actuator of claim 24 wherein the handle collar further comprises a flexible grommet.

26. The actuator of claim 15 wherein the handle assembly includes a case having a drive train compartment and an electronics compartment.

27. The actuator of claim 26 wherein the electronics compartment contains the sensor and is located such that when the actuator is mounted on a flush valve, the electronics compartment is closer to the valve body than the drive train compartment.

28. The actuator of claim 15 wherein the sensor is mounted on the handle assembly.

29. An actuator for a flush valve having a valve handle for operating the flush valve, the actuator comprising:

a housing mountable on the valve body, a handle assembly pivotally mounted to the housing and having an interface engageable with the valve handle for manually operating the valve handle, an interior space formed between the valve handle and said handle assembly, a drive motor mounted in said interior space and connected to the handle assembly, a push rod connected to the drive motor and positioned to have some slack between the valve handle and the drive motor when the drive motor is not activated and engageable with the valve handle when the drive motor is activated to cause movement of the valve handle, a power supply for operating the drive motor, and a sensor associated with the actuator and connected to the power supply to cause the application of power to the drive motor, the handle assembly being engaged with the valve handle for causing pivotal movement of the handle independent of the push rod.

30. The actuator of claim 29 wherein the interface engages the valve handle when the drive motor is not activated.

31. An actuator for a flush valve having a valve handle for operating the flush valve, the actuator comprising:

a housing mountable on the valve body, a handle assembly pivotally mounted to the housing and having an interface engageable with the valve handle, an interior space formed between the valve handle and said handle assembly, a drive motor mounted in said interior space and connected to the handle assembly, a push rod connected to the drive motor, the interface being positioned to contact the valve handle when the drive motor is not activated, user-initiated manual movement of the handle assembly causing movement of the interface and the valve handle, a power supply for operating the drive motor, and a sensor associated with the actuator and connected to the power supply to cause the application of power to the drive motor, the handle assembly being engaged with the valve handle for causing pivotal movement of the handle independent of the push rod.

32. The actuator of claim 31 wherein the push rod has some slack between the valve handle and the drive motor when the drive motor is not activated.

33. An actuator for a flush valve having a valve body and a valve handle for operating the flush valve, the actuator comprising:

a housing mountable on the valve body, a handle assembly pivotally mounted to the housing and engageable with the valve handle during user-initiated manual movement of the handle assembly, a push rod engageable with the valve handle, an interior space formed between the valve handle and said handle assembly, a motor-driven drive train mounted on in said interior space and connected to the handle assembly and connected to the push rod to pivotally move the valve handle, and a sensor associated with the actuator and selectively operating the drive train, the drive train being disengaged from the valve handle during manual movement of the handle assembly, the handle assembly being engaged with the valve handle for causing pivotal movement of the handle independent of the push rod.

34. The actuator of claim 33 wherein the handle assembly includes an interface which is in contact with the valve handle when the drive train is not activated and the drive train includes a the push rod which has some slack between the valve handle and the drive motor when the drive train is not activated.

35. In a toilet room flush valve for use in flushing toilets and urinals including a valve body having a water inlet and a water outlet, valve means within the body for controlling flow between the inlet and outlet, and a valve handle pivotally mounted on the valve body for movement to operate the valve means, the improvement comprising an actuator for causing movement of the valve handle, the actuator comprising:

a housing mountable on the valve body, a handle assembly pivotally mounted to the housing, a push rod mounted for movement with the handle assembly and relative to the handle assembly, the push rod being positioned to be engageable with the valve handle, a drive train and sensor connected to the housing and engageable with the valve handle to cause movement of the valve handle upon sensing a condition that calls for operation of the flush valve, a power supply for operating the drive train and sensor, the housing including a front cover, a rear cover and a handle collar, the handle collar being engageable with the valve body and the front and rear covers having pillars that engage the handle collar, the handle assembly being engaged with the valve handle for causing pivotal movement of the handle independent of the push rod.

36. The actuator of claim 35 wherein the handle collar includes at least one torpedo tube, and one of the front and rear covers includes at least one pillar in telescoping engagement with the torpedo tube.

37. The actuator of claim 35 wherein the handle collar includes at least one torpedo tube located between and in engagement with the pillars of the front and rear covers.

38. The actuator of claim 37 wherein the pillars are in telescoping engagement with the torpedo tube.

39. The actuator of claim 35 wherein the flush valve further comprises a handle mounting member surrounding the valve handle and having an end face witch is in a plane generally perpendicular to the valve handle, and the handle collar is engageable with the end face of the handle mounting member, and the actuator further comprises a mounting strap releasably connected to the housing and engageable with the valve body to clamp the housing to the end face of the handle mounting member.

40. The actuator of claim 39 wherein the handle mounting member is a handle socket.

41. The actuator of claim 40 wherein the handle socket includes a cup and the end face is a flange on one end of the cup, the handle collar further comprising a sleeve that fits over the cup and a flange that is engageable with the flange of the socket.

42. The actuator of claim 41 wherein the handle collar further comprises a flexible grommet.

43. In a flush valve having a valve body with a valve handle extending therefrom, the valve handle being attached to the valve body by a handle mounting member, the handle mounting member having an end face which is in a plane generally perpendicular to the valve handle, the improvement comprising an actuator mounted on the body for moving the flush valve handle, the actuator including:

a housing having a collar with an abutment formed therein for engagement with the end face of the handle mounting member, the collar including a passage for receiving the valve handle;

a handle assembly pivotally mounted to the housing, a push rod mounted for movement with the handle assembly and relative to the handle assembly, the push rod being positioned to be engageable with the valve handle, an interior space formed between the valve handle and said handle assembly, a drive motor mounted in said interior space and connected to the handle assembly and connected to the push rod to cause movement thereof, a power supply for operating the drive motor, and a sensor associated with the actuator and connected to the power supply to cause the application of power to the drive motor, the handle assembly being engaged with the valve handle for causing pivotal movement of the handle independent of the push rod; and a mounting strap releasably connected to the housing and engageable with the valve body to clamp the abutment against the end face of the handle mounting member.

44. In a flush valve having a valve body with a valve handle extending therefrom, the valve handle being attached to the valve body by a handle mounting member, the handle mounting member having an end face which is in a plane generally perpendicular to the valve handle, the improvement comprising a method of mounting an actuator housing on the flush valve body including the steps of:

providing a housing having a collar with an abutment formed therein for engagement with the end face of the handle mounting member, the collar including a passage for receiving the valve handle; and a mounting strap releasably connected to the housing and engageable with the valve body to clamp the abutment against the end face of the handle mounting member, the handle assembly being engaged with the valve handle for causing pivotal movement of the handle independent of the push rod;

sliding the actuator housing over the valve handle in a direction parallel to the axis of the valve handle until the housing abuts the end face of the handle mounting member;

wrapping a mounting strap around the valve body; and releasably connecting the mounting strap to the housing to clamp the housing to the valve body against the end face of the handle mounting member.

45. The method of claim 44 wherein the wrapping step is further characterized by pivoting the mounting strap about a hinge connecting one end of the strap and the housing.

46. The method of claim 44 wherein the connecting step is further characterized by making a threaded engagement between a screw on one of the housing and mounting strap and a nut on the other of the housing and mounting strap.

47. In a flush valve for use in flushing toilets and urinals having a valve body with a water inlet and a water outlet, valve means within the body for controlling flow between the inlet and outlet, a valve handle pivotally mounted on the valve body to operate the valve means, and an actuator mounted on the valve body for causing sensor initiated movement of the valve handle, the improvement comprising an actuator including:

a housing mounted on the valve body;

a drive train including a drive motor and having a push rod positioned to contact and move the valve handle;

a battery for operating the drive motor;

a sensor mounted on the valve body and connected to the drive motor and battery to cause the application of battery power to the drive motor;

a handle assembly pivotally mounted on the housing and including a case having a drive train compartment containing the drive train and an electronics compartment containing the sensor, the handle assembly being engaged with the valve handle for causing pivotal movement of the handle independent of the push rod.

48. The actuator of claim 47 wherein the electronics compartment is located such that when the actuator is mounted on a flush valve, the electronics compartment is closer to the valve outlet than the drive train compartment.

* * * * *